United States Patent [19]

Pertl

[11] 4,006,568

[45] Feb. 8, 1977

[54] BI-LAMINAR PRE-FINISHED WALL ELEMENT AND METHOD OF ASSEMBLING SAME

[76] Inventor: Peter Pertl, Tulpenweg 3, D-82 Rosenheim, Germany

[22] Filed: Apr. 30, 1976

[21] Appl. No.: 682,101

Related U.S. Application Data

[63] Continuation of Ser. No. 581,352, May 27, 1975, abandoned.

[30] Foreign Application Priority Data

May 25, 1974 Germany ..... 2425432

[52] U.S. Cl. ..... 52/241; 52/265; 52/745

[51] Int. Cl.[2] ..... E04B 2/80; E04B 2/88

[58] Field of Search ..... 52/275, 267, 239, 283, 52/241, 285, 242, 286, 620, 745

[56] References Cited

UNITED STATES PATENTS

| | | | |
|---|---|---|---|
| 1,477,632 | 12/1923 | Doner | 52/275 X |
| 2,091,415 | 8/1937 | Mauser | 52/275 X |
| 2,205,109 | 6/1940 | Rugg et al. | 52/287 X |
| 2,716,261 | 8/1955 | Huffman | 52/275 X |
| 3,133,322 | 5/1964 | Douglas | 52/281 X |
| 3,255,563 | 6/1966 | Sauer | 52/242 X |
| 3,339,327 | 9/1967 | Kempf | 52/241 X |
| 3,420,023 | 1/1969 | Gregori | 52/241 X |
| 3,464,170 | 9/1969 | Grover | 52/285 X |
| 3,608,258 | 9/1971 | Spratt | 52/241 |
| 3,755,979 | 9/1973 | Pantazi | 52/241 X |
| 3,774,362 | 11/1973 | Matuschak | 52/286 X |

FOREIGN PATENTS OR APPLICATIONS

| | | | |
|---|---|---|---|
| 225,583 | 2/1968 | Sweden | 52/242 |
| 770,342 | 3/1957 | United Kingdom | 52/241 |

*Primary Examiner*—Price C. Faw, Jr.
*Assistant Examiner*—Leslie Braun
*Attorney, Agent, or Firm*—Orrin M. Haugen

[57] ABSTRACT

A two-sheet, prefabricated wall unit, where the sheets are separated by spacing members, and wherein the sheet is mountable by means of a ceiling and/or floor slat that is to be secured to the room ceiling and/or the room floor, and to an installation procedure for installing these types of wall units. The wall unit is provided with means for accommodating variations which normally occur between the top edges of the sheet and the ceiling when the wall unit is being set in place.

5 Claims, 4 Drawing Figures

P1
P1'
P2
I
II

BI-LAMINAR PRE-FINISHED WALL ELEMENT AND METHOD OF ASSEMBLING SAME

This is a continuation of application Ser. No. 581,352 filed May 27, 1975, now abandoned.

BACKGROUND OF THE INVENTION

The invention relates to a two-sheet, prefabricated wall unit, where the sheets are separated by spacing members, and which is mountable through means of a ceiling and/or floor slat that is to be secured to the room ceiling and/or room floor, as well as an installation procedure for installing these types of wall units.

Known types of two-sheet wall units of the kind mentioned include two plasterboard sheets whose inside facing surfaces are adhesively bonded to a honeycomb paper sheet, with their honeycombs running perpendicularly to the sheet surfaces. In order to transpose these wall units, a ceiling slat corresponding to the length of the wall to be constructed is secured to the room ceiling. In similar manner a continuous floor slat is secured to the floor in a vertically parallel orientation to the ceiling slat. The open space between ceiling and floor slat is less than the height of the sheet for the wall unit. At present, when observing the ceiling and floor slats from the front, each wall unit is set somewhat inclined and brought up from below into engagement with the ceiling such that the ceiling is contacted at both sides by the top edges of both sheets of the respective wall unit. Since initially the wall unit displays no groove, one is generated by forcing the honeycomb paper layer inwardly in the area of the ceiling slat when installing. Engagement to the ceiling slat is, however, possible only if the width of the ceiling slat is somewhat less than the free space between the two sheets. Finally, by straightening up the wall unit, its bottom edge is brought to bear on the floor slat and is attached to the floor slat in any convenient manner whatsoever.

Since the distance between room ceiling and room floor is subject to variations in the order of approximately 1 cm, gaps occur between the top edges of the sheets and the ceiling when emplacing the wall unit, which prevents their use in the case of already finished ceilings and is also unsatisfactory in the case of unfinished ceilings because these gaps can, in spite of careful, tedious filling and troweling, later give rise to formation of cracks. Additionally, auxiliary measures must be taken to eliminate play that may be present in the area at the top between the ceiling slat and the sheets. In summary, therefore, installing known type wall units is tedious work, where a clean ceiling-fit of top edges of the sheets is not possible.

The task set forth for the invention is obtaining an improved wall unit, making possible a cleaner mounting with less work, whereby the top edges of the sheets for the wall unit are in contacting engagement with the room's ceiling. This is achieved through a continuous ceiling groove in the upper narrow surface, as well as a floor groove, extending at least over a portion of the unit's width, starting out from one side of the unit that is to be pushed against an adjacent wall unit; through a certain separate piece of ceiling slat that is to be attached to the room ceiling for engagement with the ceiling groove, the piece of ceiling slat protruding over the side of the unit that is turned away from the side of the unit that is to be pushed upon, while, with the other end adjacent to the unit side to be pushed on, is correspondingly rearwardly displaced, and which displays on its protruding portion a further protruding wedge projection. The wedge projection extends diagonally downward immediately below this for the purpose of sliding a piece of ceiling slat that is associated to an adjacent unit; through a piece of floor slat that is to be attached to the floor horizontally, in a vertically parallel orientation to the piece of ceiling slat, the piece of floor slat being intended to engage with the floor groove; and through use of fastening elements for connecting at least one sheet with the piece of floor and/or ceiling slat after raising the unit into contact with the ceiling.

The advantage of the wall unit that is in accordance with the invention lies in the fact that it is not necessary to tip from the vertical to install (the wall unit). Moreover, the wall unit that is in accordance with the invention can be slid vertically, on its interfacing, sliding side, against an already installed wall unit. After fastening the piece of floor slat to the room floor, the wall unit can be easily tilted up by use of a simple tool, in particular a lever, until the top edges of the sheets come into contact with the room ceiling. In this position both sheets can be joined to the floor and/or ceiling slat pieces, preferably pinned (stapled), so that the position of the wall unit is fixedly in contact with the ceiling. No gap appears between the top edges of the sheets and the room ceiling, which would be tedious work to fill and trowel later. In this manner also, an application of the wall unit that is in accordance with the invention would be possible for already finished ceilings, for example in office buildings where, subsequently, another floor plan might be structured by building in intermediate walls. The only limitation here lies in the fact that a gap occurs between the lower edge of the wall unit that is in accordance with the invention and the floor, so that, when using the wall unit that is in accordance with the invention, start should always be from an unfinished floor, over which, at least in the transfer area, is later placed finished flooring along with a floor covering. With this prerequisite, the flooring covers the gap between the rough floor and the wall unit that is in accordance with the invention. In practical application it has been shown that, with the wall unit that is in accordance with the invention, a savings of up to 30% in the installation time, compared to the usual wall units, can be achieved.

Other and further objects of the present invention will become more apparent to those skilled in the art upon a study of the following specification, appended claims, and accompanying drawing.

IN THE DRAWING

DESCRIPTION OF THE PREFERRED EMBODIMENT

Figures 1, 2, 3, 4:
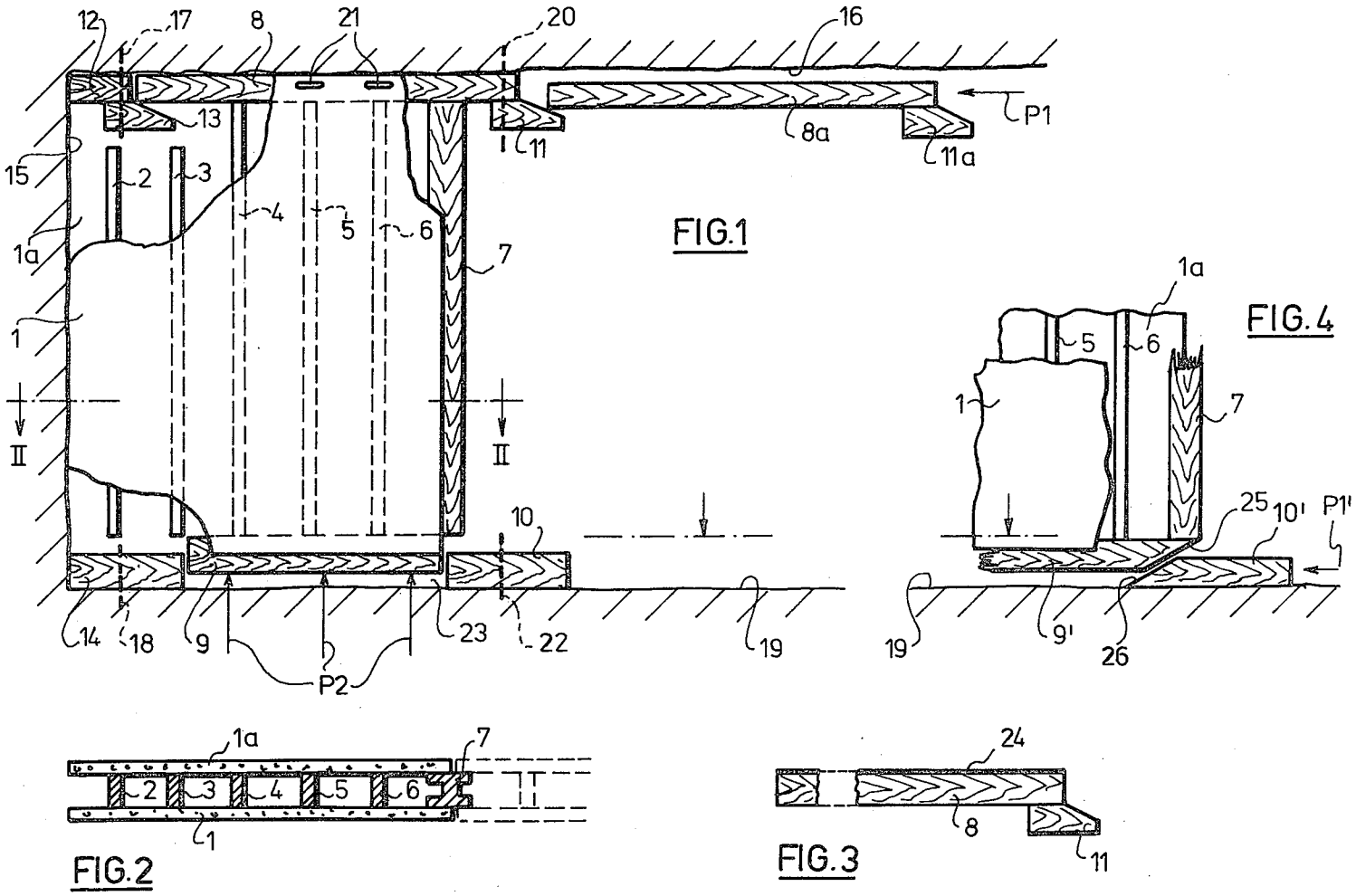
FIG. 1 is an example of embodiment for the wall unit in accordance with the invention, in a side view as well as in a partial exploded representation, immediately after installation inside of a room.
FIG. 2 is a section through the wall unit that is in accordance with the invention, along line II—II of FIG. 1.
FIG. 3 is a development of a component part of a wall unit that is in accordance with the invention, in a view similar to FIG. 1.
FIG. 4, compared to FIG. 1, is a modified example of embodiment for a wall unit that is in accordance with the invention, in a similar partial representation.

As essential components, the wall unit that is in accordance with the invention and shown in FIG. 1 includes two sheets 1, 1*a* made of room-height plasterboard sheets that are separated by spacing members 2, 3, 4, 5, 6 in the form of relatively thin slats. One spacing member 7 provided on the right hand side of the wall unit, as seen when looking in the direction of FIG. 1, displays an H-shape and serves as a tenon for engaging into the vertical groove of an adjacent wall unit (not shown). As obtained from FIG. 1, the area of the top edges of both sheets 1, 1*a* protrude past the spacing members 2–7, whereby is formed a continuous ceiling groove in the top, narrow surface of the wall unit and which is intended to engage with a piece of ceiling slat 8. The piece of ceiling slat 8 actually forms one component of the wall unit that is in accordance with the invention, but is delivered separately to the work site, i.e. hence, sheet 1, 1*a* are not joined at their upper edge with the piece of ceiling slat 8 when delivered.

In similar manner, spacing members 2–7 also do not extend to the edge of sheets 1, 1*a* on the floor side so that there is formed, at the left hand side of the wall unit when viewing in the direction of FIG. 1, a floor channel extending over only a portion of the width of the unit, in the area of spacing members 2, 3. Accommodating itself to this floor channel is an angle profile framing piece 9 that is firmly joined to both sheets 1, 1*a* as well as to the lower front surface of sapcing members 4–7. Here, the lower edge of angle profile framing piece 9 extends somewhat out over the lower edge of both sheets 1, 1*a*, preferably approximately 5 mm, so that, when setting the wall unit down onto an unfinished floor, damage to the lower edges of sheets 1, 1*a* cannot occur.

The spacing members 2, 3 located on the side of the wall unit to be extended, are somewhat shorter, relative to the other spacing members 4–7, on the top end so that the groove formed on the top, narrow surface of the wall unit in the region of spacing members 2, 3, displays a greater depth than in the area of spacing members 4–7.

The wall unit of FIG. 1 further includes a floor slat piece 10 which, like ceiling slat piece 8, is delivered at the construction site which, however, can be firmly joined to an adjacent wall unit during construction if necessary or preferred.

In a modified example of embodiment which is not shown, the angle profile framing piece 9 and the floor slat piece 10 can be produced from a single piece of same cross-section, with this assembled structural element capable of being delivered on site of separately, hence, is not joined to sheets 1, 1*a* and/or not firmly joined to sheets 1, 1*a*, e.g. by cementing or stapling. In this latter case, the installation procedure is to be changed somewhat as can be seen from the following description.

In the case of the modified example of embodiment in accordance with FIG. 4, an angle profile framing piece 9′ having the same function as structural element 9 of FIG. 1, displays, on its end that is opposite from the side of the unit that is to be pushed on (left in FIG. 4), a slide-back wedge surface 25 that is directed toward the floor while a floor slat piece 10′, whose greatest length exceeds that of floor slat piece 10 of FIG. 1, displays, on its end that is turned toward angle profile framing piece 9′, an upwardly directed, protruding, complementary wedge surface 26 for raising the element over angle profile framing piece 9′.

For a purpose to be described in the following, a wedge protrusion 11 is firmly mounted under the right hand end, viewing in the direction of FIG. 1, of ceiling slat piece 8. The length of the ceiling slat piece 8 corresponds, in the example of embodiment shown, exactly to the width of the wall unit (including spacing member 7), the slat being, however, after installation, sidewardly displaced to the right, in the direction of viewing of FIG. 1, so that the right hand portion of ceiling slat piece 8 along with wedge protrusion 11, viewing in the direction of FIG. 1, protrudes out from the wall unit, while the left hand portion of ceiling slat piece 8, viewing in the direction of FIG. 1, is correspondingly set back relative to the left hand edge of the wall unit whereby, in the form of embodiment shown, there is present a free groove in the area of spacing member 2 which (free groove) is intended for accepting a short starter-ceiling slat piece 12 along with associated wedge protrusion 13. The wedge protrusion 13 here is identical to wedge protrusion 11 of ceiling slat piece 8 while the starter-ceiling slat piece 12 corresponds in cross-section with ceiling slat piece 8 but not in length.

In similar manner, starter-floor slat piece 14 is associated with the floor channel formed at the left hand side of the wall unit, viewing in the direction of FIG. 1, which, in the example of embodiment shown, corresponds completely to floor slat piece 10.

To erect a wall using wall units that are in accordance with the invention, first, starting from an already available partition 15, the starter-ceiling slat piece 12 along with wedge protrusion 13 is fastened to a room ceiling 16, for example by shooting in a bolt 17 that is shown by heavy dash lines in FIG. 1, and starter-floor slat piece 14 is fastened down, for example by shooting in a bolt 18 that is shown by dash lines in FIG. 1. Next, the wall element is shoved face-forward against the starter-ceiling slat piece 12 along with wedge protrusion 13 as well as against the starter-floor slat piece, whereby the angle profile framing piece 9 slides on the unfinished floor 19 until the left hand edge areas of sheets 1, 1*a* impinge against partition 15, viewing in the direction of FIG. 1. Then, the ceiling slat piece 8 along with wedge protrusion 11 associated with the wall unit in question is introduced into the channel in the top narrow surface of the wall unit and butted up against wedge protrusion 13 until the ceiling slat piece 8 rests firmly against the room ceiling, at the left hand end viewing in the direction of FIG. 1. Represented in the right hand portion of FIG. 1 is this same process relative to a ceiling slat piece 8*a* along with a wedge protrusion 11*a* (direction of application of force corresponding to an arrow P1), which is arranged to an adjacent wall unit (not illustrated).

After driving in the ceiling slat piece 8 along the diagonal surface of the wedge protrusion 13, the right hand end, viewing in the direction of FIG. 1, of the ceiling slat piece 8 is fastened in the area of its wedge protrusion 11 to the room ceiling, for example by shooting in a bolt 20 that is represented by the heavy dash line. After this, the wall element can be raised vertically in the direction of arrow P2, for example by means of a lever that engages under angle profile framing piece 9, until the top edges of sheets 1, 1*a* lie firmly against room ceiling 16. In this position, the sheets 1, 1*a* are firmly joined to the ceiling slat piece 8, for example by means of staples 21 which are driven in with a normal type stapler. Selectively, or additionally, the lower edge area of sheets 1, 1*a* can also be joined in a similar manner to the starter-floor slat piece 14 (which for the sake of better illustration is shown in FIG. 1). Finally, floor slat piece 10 is fastened to the floor immediately adjacent to the angle profile framing piece 9, for example by shooting in a bolt 22 illustrated in FIG. 1 by heavy dash lines.

Starting out from the projecting portion of ceiling slat piece 8 along with its associated wedge protrusion 11 as well as floor slat piece 10 of the first wall unit erected in this manner, additional wall units can now be installed in similar manner in any interconnecting order whatsoever, whereby, under each wall unit, there is present a floor gap 23 extending over the greater portion of the width. After setting all wall units into place in the desired order, the floor gaps 23 are filled with mortar, which can be done when laying in the finished flooring and, accordingly, takes less time than troweling floor joints as in the case of known type wall units.

If, in accordance with a previously mentioned modification of the invention, floor slat plate 10 and angle profile framing piece 9 for each wall unit is formed of a single piece and is already firmly joined with sheets 1, 1*a* at the building site, then, when installing, care must be taken that the wall unit also be fixed on its bottom side against floor 19, whereby, instead of fastening with a bolt 22, anchor cleats can be driven in in order to achieve a temporary attachment until pouring of the finished flooring. After finishing the flooring, the wall is firmly affixed at the bottom as has been described, in conjunction with FIG. 1, for the mounting procedure.

In constructing the wall unit in accordance with FIG. 4, the mounting procedure runs along the same as for the example of FIG. 1 up to fastening the ceiling slat piece 8 to the room ceiling by shooting in bolt 20. From then on, however, in any event after raising the wall unit through means of a bottom engaging lever, the floor slat piece 10' is brought into place by driving, in the direction of an arrow P1', against the diagonal wedged surface of the angle profile framing piece 9' until the wall unit has reached a position that is represented in FIG. 4 relative to angle profile framing piece 9' and where, analogously to the representation in FIG. 1, the top edges of sheets 1, 1*a* rest firmly against the room ceiling. In this position, floor slat piece 10' can be attached to the unfinished floor 19, between sheets 1, 1*a* and the ceiling slat piece (not shown in FIG. 4) can, in any event, be ensured. The remaining work processes are carried out the same as was explained in conjunction with FIG. 1.

In order to obtain an especially satisfactory bearing against the room ceiling, in particular in the case of uneven ceilings, according to FIG. 3, the top surface of the ceiling slat piece 8 intended for bearing against room ceiling 16, can be covered with an elastic, sound absorbing strip 24 which can consist, for example, of felt or soft plastic material.

I claim:

1. Merging inner wall units for installation in building structures to have finished floors and ceilings and consisting of at least first and second prefabricated wall units, each unit having two opposed outer sheet surfaces separated by spacing members forming a frame and wherein the top and bottom edge surfaces of the wall units are provided with continuous ceiling grooves and floor channels respectively, said grooves and channels each being respectively arranged to accept a ceiling slat and a fixed floor slat of approximately corresponding rectangular cross-section, the floor slat being a part of said frame, and said ceiling slat being further arranged to be fastened to the room ceiling, said wall units being characterized in that:

a. each wall unit comprises a lateral remote vertical edge and a lateral proximal edge, a ceiling inner starter slat piece having a portion projecting over the remote edge of the wall unit within said ceiling groove, with the remaining portion of said ceiling groove being arranged to receive the ceiling slat of the said wall unit, with said proximal end of said ceiling slat having a projecting portion with a projecting wedge protrusion extending slopingly downwardly and over the lateral remote vertical edge of the adjacent wall unit to be subsequently installed for receiving a ceiling slat associated with said adjacent wall unit to be subsequently installed;

b. each wall unit having a floor slat element therein, said floor slat element having a length less than the width of the wall unit to which it is attached, said floor slat element being disposed along a substantial portion of said wall and extending to said proximal vertical edge and cooperating with an extension segment extending longitudinally outwardly from said floor slat, the proximal end of said floor slat having a wedge surface extending slopingly upwardly, and the opposed end surface of said segment having a corresponding wedge surface extending slopingly downwardly, said extension segment being arranged for accepting the floor channel of an adjacent wall unit to be subsequently installed, and being further adapted to be disposed horizontally adjacent the complementary wedge surface of said floor slat for raising said first wall unit upwardly from the floor surface.

2. The merging wall units as defined in claim 1 being particularly characterized in that at least one of said opposed outer sheets is secured to said ceiling slat with said wall unit being retained in raised disposition.

3. The merging wall units as defined in claim 1 being particularly characterized in that the bottom edge of said floor slat extends beyond the bottom edge of each of said opposed outer sheets.

4. The merging wall units as defined in claim 1 being particularly characterized in that the top edge surface of said ceiling slat is overlaid with an elastic sound-absorbing strip.

5. A procedure for the installation of a wall unit in a building structure to have finished floors and ceilings and wherein the wall unit consists of at least first and second prefabricated wall units, each unit having two opposed outer sheet surfaces separated by spacing members forming a frame and wherein the top and bottom edge surfaces of the wall units are provided with continuous ceiling grooves and floor channels respectively, said grooves and channels each being respectively arranged to accept a ceiling slat and a fixed floor slat of approximately corresponding rectangular cross-section, the floor slat being a part of said frame, and said ceiling slat being further arranged to be fastened to the room ceiling, wherein said wall units are characterized in that:

a. each wall unit comprises a lateral remote vertical edge and a lateral proximal edge, a ceiling inner starter slat piece having a portion projecting over the remote edge of the wall unit within said ceiling groove, with the remaining portion of said ceiling groove being arranged to receive the ceiling slat of the said wall unit, with said proximal end of said ceiling slat having a projecting portion with a projecting wedge protrusion extending slopingly downwardly and over the lateral remote vertical edge of the adjacent wall unit to be subsequently installed for receiving a ceiling slat associated with said adjacent wall unit to be subsequently installed;

b. each wall unit having a floor slat element therein, said floor slat element having a length less than the width of the wall unit to which it is attached, said floor slat element being disposed along a substantial portion of said wall and extending to said proximal vertical edge and cooperating with an extension segment extending longitudinally outwardly from said floor slat, the proximal end of said floor slat having a wedge surface extending slopingly upwardly, and the opposed end surface of said segment having a corresponding wedge surface extending slopingly downwardly, said extension segment being arranged for accepting the floor channel of an adjacent wall unit to be subsequently installed, and being further adapted to be disposed horizontally adjacent the complementary wedge surface of said floor slat for raising said first wall unit upwardly from the floor surface; said method comprising:

1. fastening a short ceiling starter slat piece and a floor extension segment to a room ceiling and floor respectively, with the ceiling slat piece segments each having a wedge protrusion thereon, forcing a wall unit with its ceiling groove and floor channel respectively over the starter ceiling slat piece wedge protrusion and floor extension segment respectively;
2. forcing the ceiling slat of the wall unit adjacent said protrusion until abutment is achieved with the ceiling, and securing the proximal end of said ceiling slat onto the ceiling surface, thereafter raising the unit to the point of contact of the opposed outer sheets with the ceiling and driving the floor extension segment having the wedge surface against the wedge surface of the floor slat;
3. fastening said floor extension segment to the floor; and
4. placing an additional wall unit in place starting from the then extending ceiling slat piece wedge protrusion and floor extension segment of the last-installed wall unit.

* * * * *